US009683798B2

(12) United States Patent
Butler

(10) Patent No.: US 9,683,798 B2
(45) Date of Patent: Jun. 20, 2017

(54) FIREARM MAGAZINE LOADER AND METHOD OF USE

(71) Applicant: Charles Anders Butler, San Diego, CA (US)

(72) Inventor: Charles Anders Butler, San Diego, CA (US)

( * ) Notice: Subject to any disclaimer, the term of this patent is extended or adjusted under 35 U.S.C. 154(b) by 0 days.

(21) Appl. No.: 15/158,811

(22) Filed: May 19, 2016

(65) Prior Publication Data

US 2017/0115082 A1 Apr. 27, 2017

Related U.S. Application Data

(60) Provisional application No. 62/245,158, filed on Oct. 22, 2015.

(51) Int. Cl.
*F41A 9/83* (2006.01)

(52) U.S. Cl.
CPC ..... *F41A 9/83* (2013.01)

(58) Field of Classification Search
CPC .... F41A 9/83; F41A 9/82; F42B 39/00; F42B 39/002
USPC ..... 42/87, 90; 224/196, 197, 198, 199, 200
See application file for complete search history.

(56) References Cited

U.S. PATENT DOCUMENTS 201,855 A * 3/1878 White ..... F41A 9/83 224/239
202,613 A * 4/1878 White ..... F41A 9/72 42/87
1,163,369 A * 12/1915 Ross ..... F42B 39/02 224/199
4,081,115 A * 3/1978 White ..... A01K 97/10 224/200
4,120,109 A * 10/1978 Musgrave ..... F42B 39/02 42/90
5,598,958 A * 2/1997 Ryan, III ..... F41C 33/045 224/192
5,641,102 A * 6/1997 Hellweg ..... A45F 5/00 224/198
5,937,559 A * 8/1999 Jennen ..... F41A 23/18 211/64
6,050,464 A * 4/2000 Ramsey, Sr. ..... F41A 9/61 206/3
6,154,997 A 12/2000 Aluotto et al.
(Continued)

*Primary Examiner* — Joshua Freeman
(74) *Attorney, Agent, or Firm* — Procopio Cory Hargreaves and Savitch LLP

(57) ABSTRACT

A one hand firearm magazine loader for loading a firearm with a firearm magazine including a lower member includes a one-piece magazine support housing including a wall that terminates in a lower end in a receiving section; support arms extending laterally from the vertical wall for retaining a firearm magazine in a substantially vertical position, vertical position; a rotating support rotatably received in the receiving section for rotation about a first axis-between the substantially vertical position and an angled position; and a magazine receiving member carried by the rotating support, the magazine receiving member slidably receiving the lower member of the firearm magazine, the magazine receiving member rotatably mounted to a top of the rotating support for rotation about a second axis, different from the first axis, of the firearm magazine with mounted firearm.

19 Claims, 6 Drawing Sheets

(56) References Cited

U.S. PATENT DOCUMENTS

| | | | | |
|---|---|---|---|---|
| 7,025,238 | B2 * | 4/2006 | Hughes | A45F 5/00 206/3 |
| 7,780,048 | B2 | 8/2010 | Howell | |
| 8,555,538 | B2 * | 10/2013 | Huffines | F41A 9/65 206/3 |
| 8,733,606 | B2 | 5/2014 | Felts | |
| 8,783,532 | B2 * | 7/2014 | Gregory | F41C 33/045 224/198 |
| 8,887,972 | B2 | 11/2014 | Solomon | |
| 9,182,205 | B2 * | 11/2015 | Sitz | F41A 23/18 |
| 9,395,153 | B2 * | 7/2016 | Bottrell | F41C 27/00 |
| 9,404,696 | B2 * | 8/2016 | Karimullah | F41A 9/52 |
| 2007/0278269 | A1 | 12/2007 | Rogers et al. | |
| 2010/0243690 | A1 * | 9/2010 | Lerch | A45F 5/02 224/198 |
| 2010/0276463 | A1 * | 11/2010 | Gregory | F41C 33/045 224/198 |
| 2014/0041275 | A1 | 2/2014 | Herrington | |
| 2014/0082987 | A1 * | 3/2014 | Boll | A01M 31/02 42/94 |
| 2015/0219413 | A1 | 8/2015 | Karimullah et al. | |
| 2015/0362277 | A1 * | 12/2015 | Frey | F41A 23/06 42/94 |
| 2016/0084606 | A1 * | 3/2016 | Michal | F41C 27/00 42/90 |
| 2016/0109208 | A1 * | 4/2016 | Bottrell | F41A 9/24 42/90 |

* cited by examiner

FIREARM MAGAZINE LOADER AND METHOD OF USE

CROSS-REFERENCE TO RELATED APPLICATION

This application claims priority to provisional patent application No. 62/245,158 filed on Oct. 22, 2015, which is incorporated by reference herein

FIELD OF THE INVENTION

The present invention relates to tactical firearm loading devices.

BACKGROUND OF THE INVENTION

Existing conditions for loading a small firearm (hand gun) with one hand is implemented with various tactical maneuvers which is time consuming and at times slow and unsafe.

SUMMARY OF THE INVENTION

An aspect of the invention involves a one hand firearm magazine loader for loading a firearm with a firearm magazine. The one hand firearm magazine loader includes a lower member having a one-piece magazine support housing including a wall that terminates in a lower end in a receiving section; support arms extending laterally from the vertical wall for retaining a firearm magazine in a substantially vertical position, vertical position; a rotating support rotatably received in the receiving section for rotation about a first axis-between the substantially vertical position and an angled position; and a magazine receiving member carried by the rotating support, the magazine receiving member receiving the lower member of the firearm magazine.

One or more implementations of the aspect of invention described above includes one or more of the following: the magazine receiving member is rotatably mounted to a top of the rotating support for rotation about a second axis, different from the first axis, of the firearm magazine with mounted firearm; a ratchet mechanism between the magazine receiving member and the rotating support, creating a ratcheting effect when rotating the magazine receiving member to a downwardly angled position relative to the rotating support; the magazine receiving member rotates about the second axis to a downwardly angled position relative to the rotating cylinder; the magazine receiving member rotates about the first axis less than 90 degrees relative to the substantially vertical position; the magazine receiving member rotates about the first axis 60 degrees relative to the substantially vertical position; the magazine receiving member rotates about the first axis 45 degrees relative to the substantially vertical position; the firearm includes a handle with a bottom magazine receiving member includes top flanges having a thickness t that allow a bottom of the handle of the firearm to fully engage the firearm magazine so that the firearm magazine does not accidentally dislodge from the handle; the thickness t is no greater than 0.04 inches; the rotating support in conjunction with a bottom of the handle of the firearm, the rotating support, and the magazine receiving member including substantially similar dimensions enable the rotating support and the magazine receiving member to provide a sturdy, solid engagement structure to lock the firearm onto the firearm magazine.

Another aspect of the invention involves a method of using the one hand firearm magazine loader described above, comprising: providing the rotating support of the one hand firearm magazine loader at an angled position relative to the substantially vertical position; inserting a bottom of the firearm magazine into the magazine receiving member; rotating the rotating support, magazine receiving member and firearm magazine to the substantially vertical position; securing the rotating support, magazine receiving member and firearm magazine with the pair of support arms.

One or more implementations of the aspect of invention described immediately above includes one or more of the following: clipping the one hand firearm magazine loader to a support structure on the user with the clip of the one hand firearm magazine loader; using one hand, right or left, of the user and placing a barrel of the firearm onto the magazine with the rotating support, magazine receiving member and firearm magazine in the substantially vertical position until a bottom of the barrel is stopped by the pair of support arms; using the same hand of the user to rotate the rotating support, magazine receiving member, firearm magazine, and firearm away from the substantially vertical position and causing the barrel of the firearm to continue motion onto the firearm magazine so that the firearm magazine is fully inserted into the firearm; using the same hand of the user to move the firearm forward, sliding it off the magazine receiving member, locked and loaded ready to fire, all with the same hand; and/or rotating the magazine receiving member about the second axis relative to the rotating support and using the same hand of the user to move the firearm, sliding it off the magazine receiving member, locked and loaded ready to fire, all with the same hand.

DETAILED DESCRIPTION OF EMBODIMENTS OF INVENTION

Figure 1A:
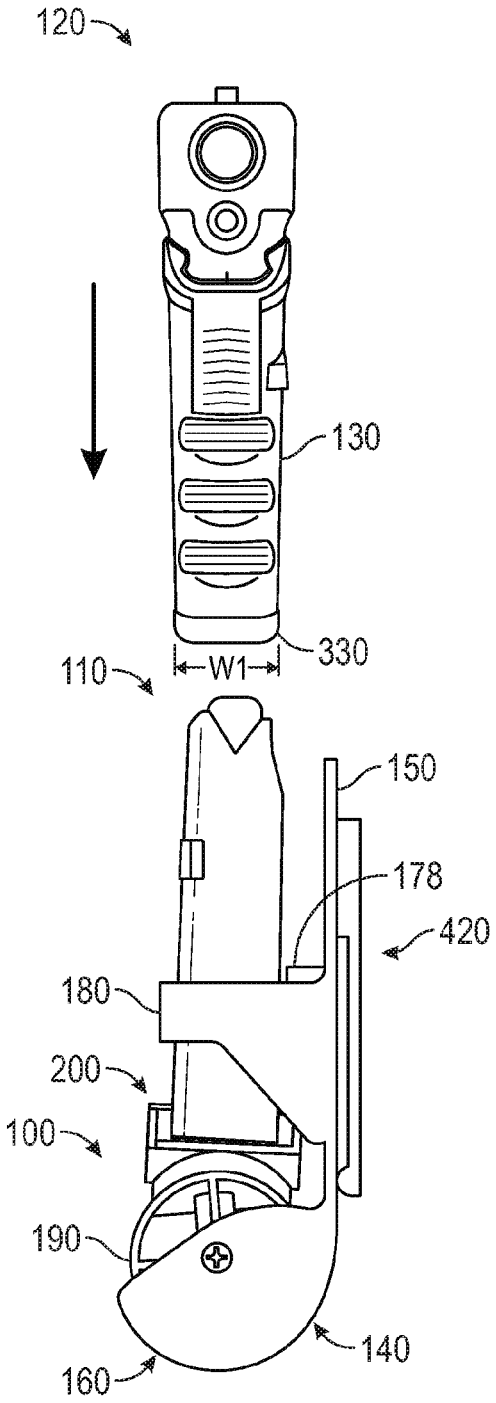
FIG. 1A is a front elevational view of an embodiment of a tactical firearm loading device and shows a firearm magazine loaded in the tactical firearm loading device in a secured up-right, 90 degree position, ready for use, and a firearm above the loaded firearm magazine.

With reference to FIGS. 1A to 2B, an embodiment of a rapid tactical one hand firearm magazine loader ("firearm magazine loader") 100 for right-handed firearm users will be described. The firearm magazine loader 100 is shown with a firearm magazine 110 loaded in the tactical firearm loading device 100 and with a firearm (e.g., hand gun) 120 having a hollow handle 130 that the firearm magazine 110 is loaded into using the firearm magazine loader 100.

The firearm magazine loader 100 includes a one-piece magazine support housing 140 include a vertical wall 150 that terminates in a lower end in a rotating cylinder receiving section 160. A support block member 178 and a pair of support arms 180 extend laterally from the vertical wall 150 for retaining the firearm magazine 110 in the substantially vertical position vertical position shown in FIGS. 1A and 1B.

Figure 1B:
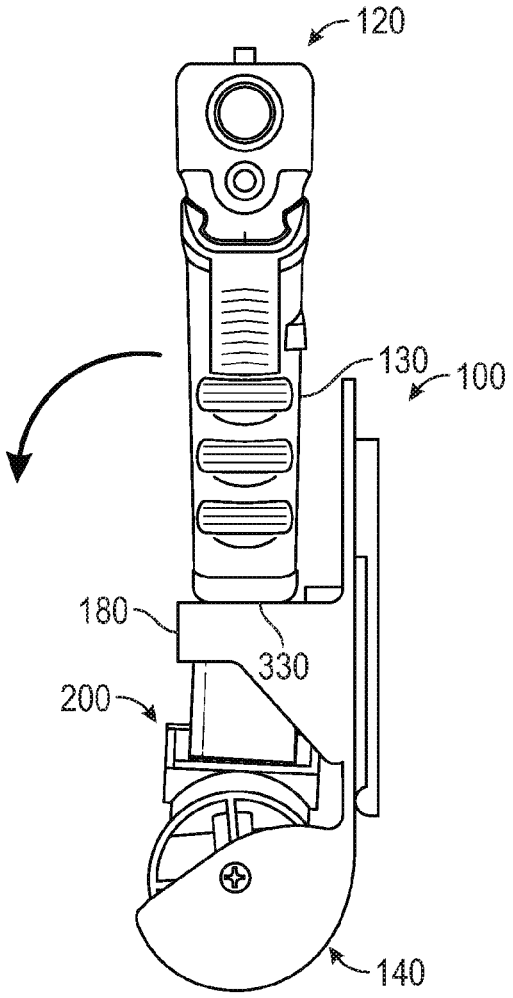
FIG. 1B is a front elevational view similar to FIG. 1A and shows the firearm magazine partially loaded into a handle of the firearm.
Figure 2A:
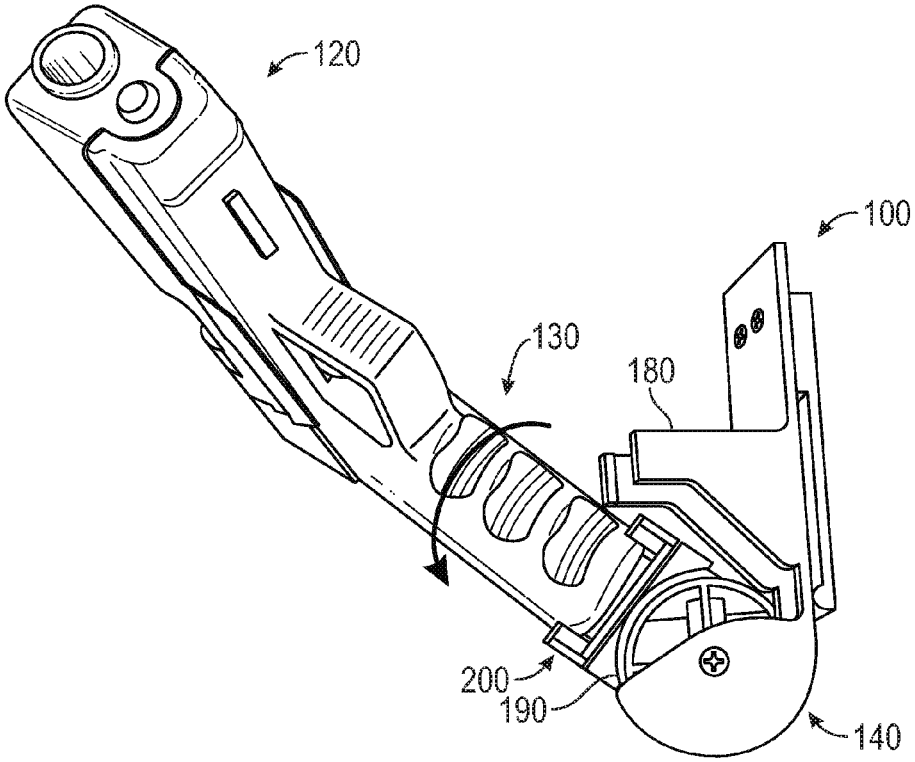
FIG. 2A is a perspective view of the tactical firearm loading device with loaded firearm magazine and firearm shown rotated to a 45 degree position via a rotating cylinder and with the firearm magazine completely loaded into the handle of the firearm.

A rotating cylinder or rotating support 190 with dimensions W3, L3 is rotatably received in the rotating cylinder receiving section or socket 160 for rotation about a first axis 192 of the firearm magazine 110 with mounted firearm 120 between the substantially vertical, substantially vertical position shown in FIGS. 1A, 1B, and the forty five degree position shown in FIGS. 2A and 2D. In a preferred embodiment, the magazine receiving member rotates with the rotating support about the first axis less than 90 degrees relative to the substantially vertical position. In a more preferred embodiment, the magazine receiving member rotates with the rotating support about the first axis 60 degrees relative to the substantially vertical position. In a most preferred embodiment, the magazine receiving member rotates with the rotating support about the first axis 45 degrees relative to the substantially vertical position.

A magazine receiving plate or member 200 with dimensions W2, L2 slidably receives lower member 210 of the firearm magazine 110. The magazine receiving plate 200 is rotatably mounted to a top of the rotating cylinder 190 for rotation about a second axis 212 of the firearm magazine 110 with mounted firearm 120 to a downwardly angled position (FIG. 2B) relative to the position of the magazine receiving plate 200, firearm magazine 110, and mounted firearm 120 in FIG. 2A.

Figure 3:
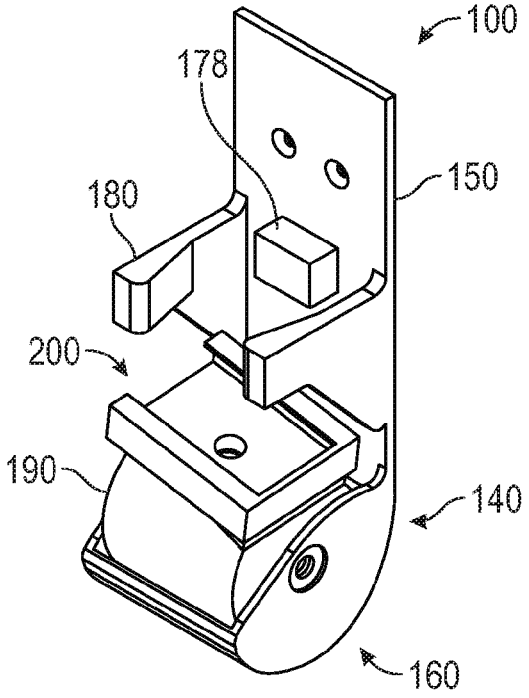
FIG. 3 is a perspective view of another embodiment of a tactical firearm loading device.
Figure 4A:
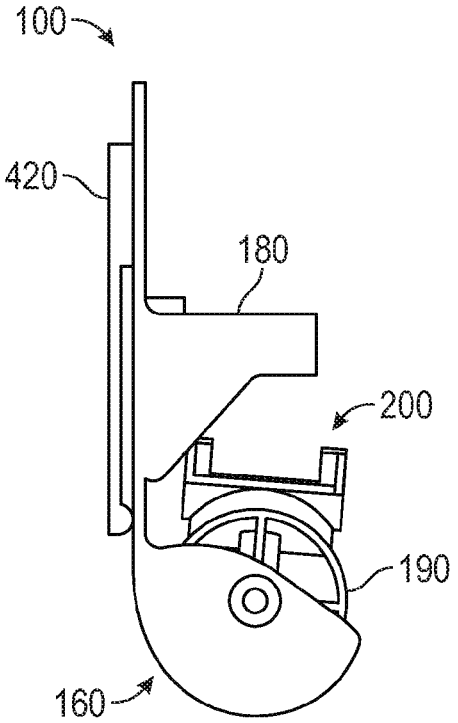
FIG. 4A is a front elevational view of the embodiment of the tactical firearm loading device shown in FIG. 3.
Figure 4B:
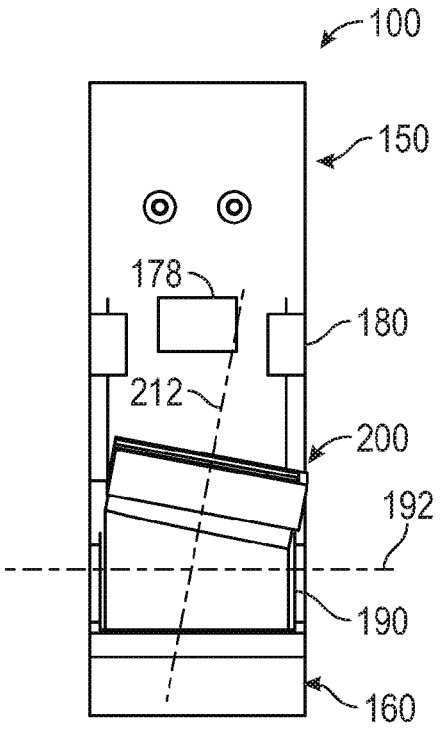
FIG. 4B is a right elevational view of the embodiment of the tactical firearm loading device shown in FIG. 3.
Figure 5:
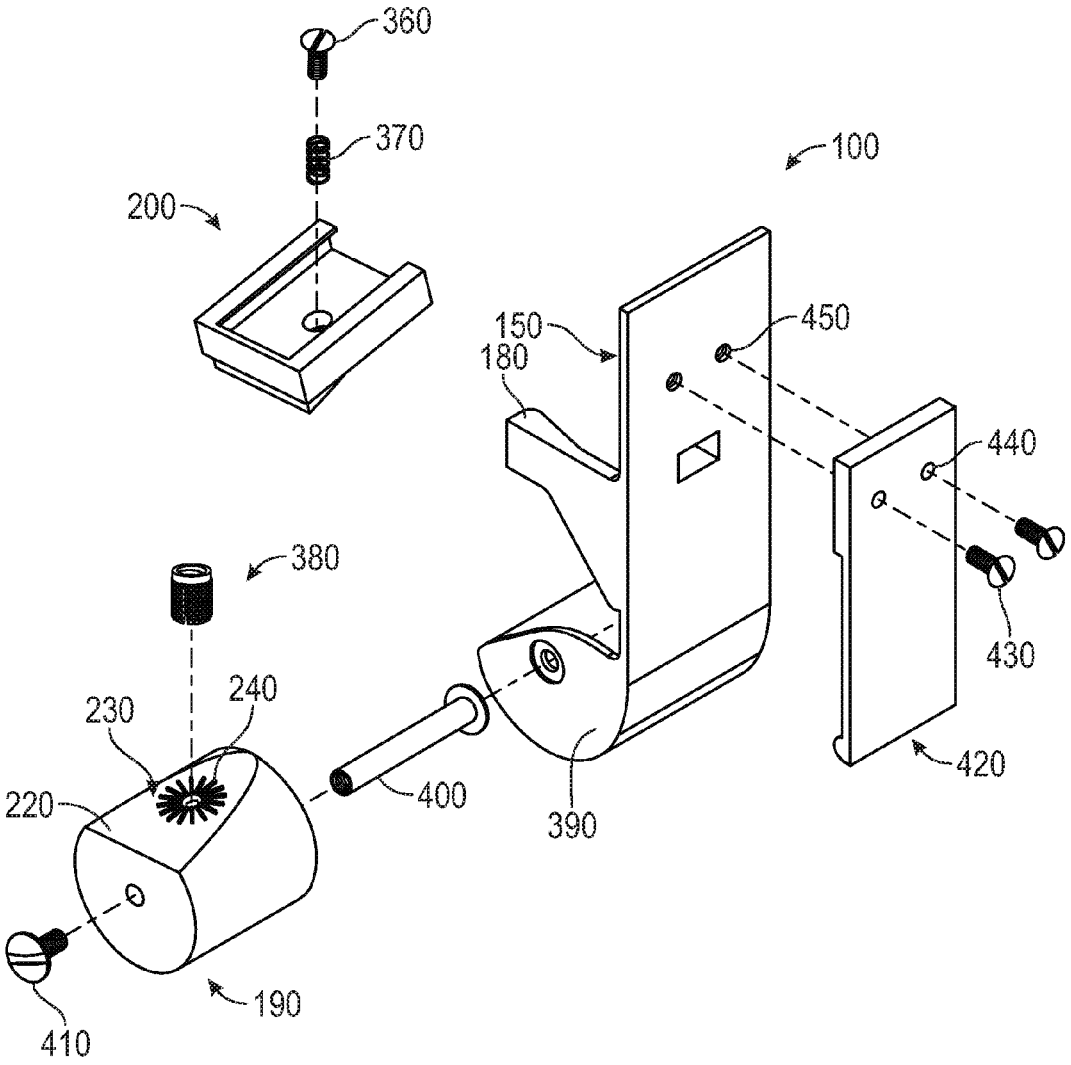
FIG. 5 is an exploded perspective view of the embodiment of the tactical firearm loading device shown in FIG. 3.
Figure 6A:
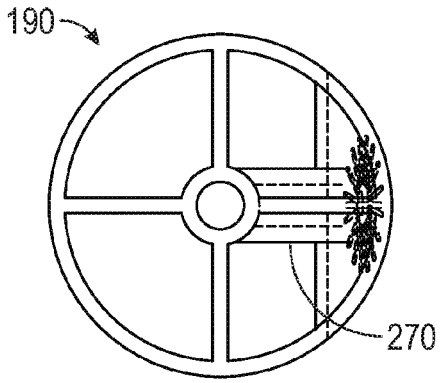
FIGS. 6A, 6B, 6C, 6D are end, perspective, side, and top views of an embodiment of a rotating cylinder or rotating support of the tactical firearm loading device.
Figure 6B:
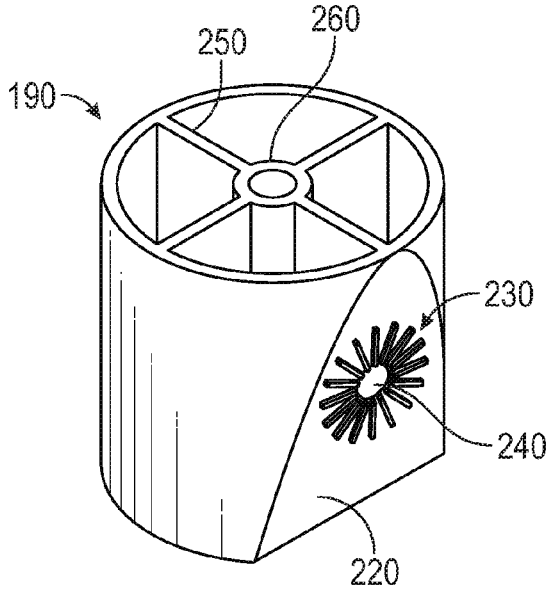
Figure 6C:
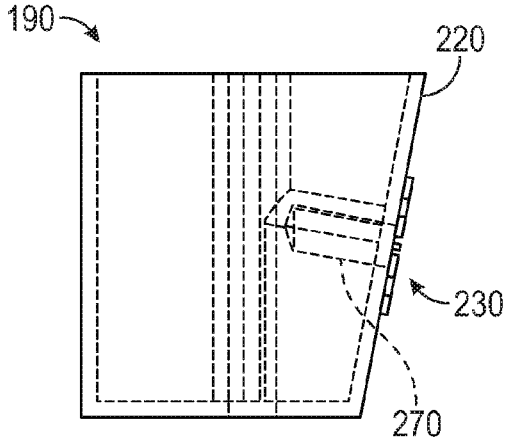
Figure 6D:
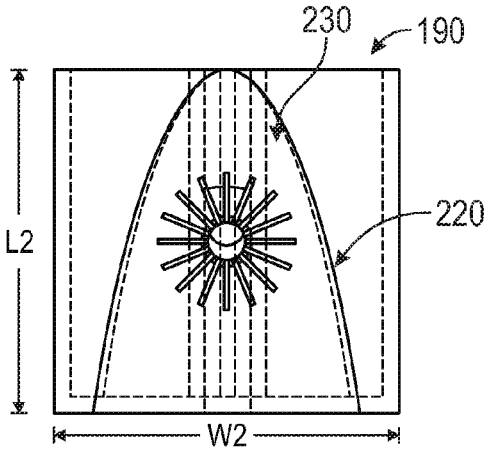
Figure 7A:
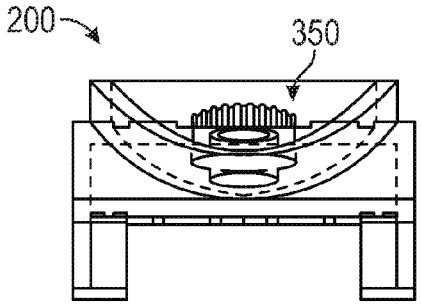
FIGS. 7A, 7B, 7C, 7D are end, perspective, side, and top views of an embodiment of a magazine receiving plate of the tactical firearm loading device.
Figure 7B:
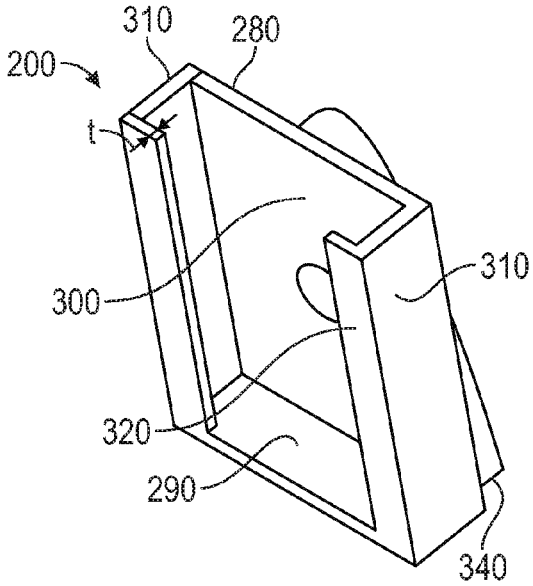
Figure 7C:
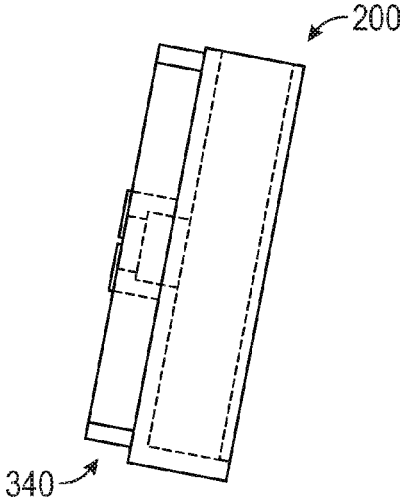
Figure 7D:
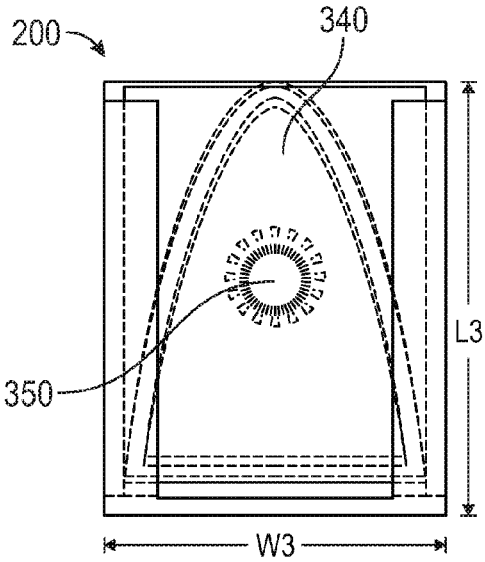

With reference additionally to FIGS. 3-5, which shows a firearm magazine loader 100 for left-handed firearm users, further aspects of the firearm magazine loader 100 will be described.

The rotating cylinder 190 includes a substantially hollow and cylindrical construction with an inclined substantially triangular support face 220. The support face 220 includes a sunburst pattern of ridges 230 and hole 240 therein. The rotating cylinder 190 includes internal walls 250 and a pin receiving cylindrical member 260. An internally threaded cylindrical member 270 defines the hole 240.

Figure 2B:
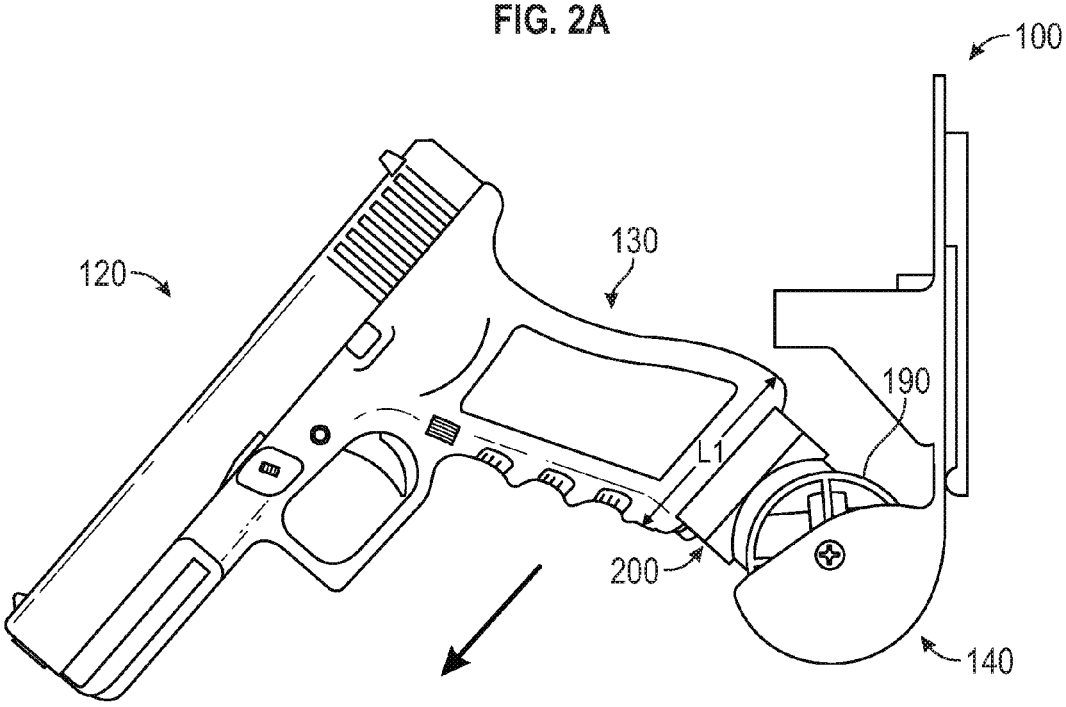
FIG. 2B is a perspective view of the tactical firearm loading device with loaded firearm magazine and firearm shown rotated to a 45 degree position via a rotating cylinder and with the firearm shown rotated 90 degrees via a rotating plate.

The plate 200 has a substantially rectangular configuration an includes a bottom wall 280, end wall 290, opposite open end 300, and side walls 310. Thin top flanges 320 extend laterally inward from side walls 310. The thin top flanges 320 have a thickness t, in a preferred embodiment, of no greater than 0.04 inches so that a bottom/end 330 of the handle 130 of the firearm 120 can fully engage the firearm magazine 110 (so that the firearm magazine 110 does not dislodge from the handle 130) while allowing the firearm magazine 110 with mounted firearm 120 to easily slide off of the plate 200. In a more preferred embodiment, the thickness t is 0.04 inches. A bottom of the plate 200 includes a substantially triangular support face 340 with a sunburst ratchet pattern 350 that cooperates with the sunburst pattern of ridges 230 of the support face 220 of the rotating cylinder 190 for creating a ratcheting effect when rotating the plate 200 to a downwardly angled position relative to the rotating cylinder 190 as shown in FIGS. 2A and 2B. The plate 200 is rotatably mounted to the rotating cylinder 190 via plate fastener 360, vertical spring 370, and bushing 380.

The rotating cylinder 190 is rotatably mounted to end walls 390 of the rotating cylinder receiving section 160 via support pin 400 and rotating cylinder fastener 410.

A clip 420 is mounted to a rear of the wall 150 of the magazine support housing 140 via clip fasteners 430 that extend through holes 440 and are threadably engaged in internally threaded sections 450.

The firearm magazine loader 100 will now be described in use. Prior to clipping the firearm magazine loader 100 to one's duty belt or pants, the user will place the loaded firearm magazine 110 into the plate 200 by positioning the firearm magazine loader 100 with the rotating cylinder rotated to the forty five degree position/configuration shown in FIG. 2A or 2B. The firearm magazine 110 is secured onto the rotating cylinder 190 by sliding a bottom of the firearm magazine 110 into the plate 200. Once the firearm magazine 110 is secured onto the cylinder rotating cylinder 190 via the plate 200, the user will push the firearm magazine 110, causing rotation of the rotating cylinder 190, into the magazine support housing 140, snapping/clipping it into position at a substantially vertical position angle/position shown in FIG. 1A, secured in that position by the support arms 180. These simple steps make the device ready for use. The firearm magazine loader 100 is then clipped via the clip 420 to the person's duty belt, pants, etc. (e.g., user's waist/mid anatomy).

When a user is ready to load the firearm magazine 110 into the hollow handle 130 of the firearm 120, using one hand, right or left, the user will place their firearm 120 emptied of the firearm magazine onto the top portion of the secured firearm magazine 110 (at its substantially vertical position as shown in FIG. 1A) sliding the firearm 120 downward until the downward motion stops, the bottom 330 of the firearm 120 abutting and stopped by a top of the support arms 180 as shown in FIG. 1B. Then, once the firearm 120 has reached its stopping point, the user completes the loading magazine process by pulling the firearm 120 out and away from the magazine support housing 140 and one's body, causing rotation via the rotating cylinder 190 of the firearm 120 with partially loaded firearm magazine 110 to the forty five degree position shown in FIG. 2A and allowing the firearm 120 to continue its downward motion onto the firearm magazine 110 so that the firearm magazine 110 is fully inserted into the firearm 120. As mentioned above, the thin top flanges 320 have a thickness t that allow a bottom 330 of the handle 130 of the firearm 120 to fully engage the firearm magazine 110 (so that the firearm magazine 110 does not dislodge from the handle 130). The user will now pull the firearm 120 forward, sliding it off the plate 200 on the rotating cylinder 190, locked and loaded ready to fire, all with one hand. The firearm magazine 110 with mounted firearm 120 easily slides forward, off of the plate 200.

Alternatively, if the user is in a space-restricted, tight situation/scenario where the firearm magazine 110 with mounted firearm 120 is not able to be slid forward, off of the plate 200, the user rotates the plate 200 to a downwardly angled position positions relative to the rotating cylinder 190 via the rotating ratchet mechanism to the position shown in FIG. 2B. In this rotated position, the firearm magazine 110 with mounted firearm 120 easily slides forward, off of the plate 200 so that the loaded firearm 120 is ready for use.

Advantages of the firearm magazine loader 100 include: the one hand tactical firearm loading device 100 eliminates having to utilize the various tactical maneuvers making the reloading of the firearm 120 with one hand safer and faster; the one hand tactical firearm loading device 100 enables the user to maintain a visual on all surrounding activities and reload the firearm 120 with one hand in a safe and extremely fast method; the rotating cylinder/support 190 of the one hand tactical firearm loading device 100 in conjunction with substantially similar dimensions W2, L2 and W3, L3 of the rotating cylinder/support 190 and the plate 200, respectively, compared to the dimensions W1, L1 of the bottom/end 330 of the handle 130, enable the rotating cylinder/support 190 and the magazine receiving member/plate 200 to provide a sturdy, solid engagement structure to lock the firearm onto the firearm magazine; and/or the one hand tactical firearm loading device 100 enables a user in a space-restricted, tight situation/scenario, where the firearm magazine 110 with mounted firearm 120 is not able to be slid forward, off of the plate 200, to rotate the firearm magazine 110 with mounted firearm 120 to a downwardly angled position positions to allow the user to slide the firearm magazine 110 with mounted firearm 120 laterally relative to the firearm magazine loader 100, off of the plate 200. Another advantage of the firearm magazine loader 100 is that it allows for flashlight tactical holding technics. There are several ways of holding a flashlight with one hand while the other hand occupies the firearm. While shining the light in front of one's activities, shooting and having to reload present the problem of now placing the flashlight back into its holder or elsewhere on your person and then reloading the firearm with both hands. By doing this, one now loses sight of the activities around you. With the one-hand firearm magazine loader 100, a user/shooter can reload with one hand while maintaining Illumination, presenting a safer condition for the user/shooter, and a faster firearm load.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. A one hand firearm magazine loader for loading a firearm with a firearm magazine including a lower member, comprising:

a one-piece magazine support housing including a vertical wall that terminates in a lower end in a receiving section;

support arms extending laterally from the vertical wall for retaining a firearm magazine in a substantially vertical position, vertical position;

a rotating cylinder rotatably received in the receiving section for rotation about a first axis between the substantially vertical position and an angled position;

a magazine receiving member carried by the rotating cylinder, the magazine receiving member receiving the lower member of the firearm magazine and including a width, and the rotating cylinder having a diameter with dimension substantially the same as the width of the magazine receiving member.

2. The one hand firearm magazine loader of claim 1, wherein the magazine receiving member rotates about the first axis less than 90 degrees relative to the substantially vertical position.

3. The one hand firearm magazine loader of claim 1, wherein the magazine receiving member rotates about the first axis 60 degrees relative to the substantially vertical position.

4. The one hand firearm magazine loader of claim 1, wherein the magazine receiving member rotates about the first axis 45 degrees relative to the substantially vertical degree position.

5. A firearm and the one hand firearm magazine loader of claim 1, wherein the firearm includes a handle with a bottom magazine receiving member including top flanges having a thickness t that allow a bottom of the handle of the firearm to fully engage the firearm magazine so that the firearm magazine does not accidentally dislodge from the handle.

6. The firearm and the one hand firearm magazine loader of claim 5, wherein the thickness t is no greater than 0.04 inches.

7. The firearm and the one hand firearm magazine loader of claim 5, wherein the rotating cylinder in conjunction with a bottom of the handle of the firearm, the rotating cylinder, and the magazine receiving member include substantially similar dimensions enabling the rotating support and the magazine receiving member to provide a sturdy, solid engagement structure to lock the firearm onto the firearm magazine.

8. The one hand firearm magazine loader of claim 1, wherein the receiving section is a socket that rotatably receives the rotating cylinder.

9. A one hand firearm magazine loader for loading a firearm with a firearm magazine including a lower member, comprising:

a one-piece magazine support housing including a vertical wall that terminates in a lower end in a receiving section;

support arms extending laterally from the vertical wall for retaining a firearm magazine in a substantially vertical position, vertical position;

a rotating support rotatably received in the receiving section for rotation about a first axis between the substantially vertical position and an angled position;

a magazine receiving member carried by the rotating support, the magazine receiving member receiving the lower member of the firearm magazine, wherein the magazine receiving member is rotatably mounted to a top of the rotating support for rotation about a second axis, substantially perpendicular to the first axis, of the firearm magazine with mounted firearm.

10. The one hand firearm magazine loader of claim 9, further including a ratchet mechanism between the magazine receiving member and the rotating support, creating a ratcheting effect when rotating the magazine receiving member to a downwardly angled position relative to the rotating support.

11. The one hand firearm magazine loader of claim 9, wherein the magazine receiving member rotates about the second axis to a downwardly angled position relative to the rotating support.

12. A method of using a one hand firearm magazine loader for loading a firearm with a firearm magazine including a lower member, the one hand firearm magazine loader comprising a one-piece magazine support housing including a vertical wall that terminates in a lower end in a receiving section; support arms extending laterally from the vertical wall for retaining a firearm magazine in a substantially vertical position, vertical position; a rotating support rotatably received in the receiving section for rotation about a first axis between the substantially vertical position and an angled position; a magazine receiving member carried by the rotating support, the magazine receiving member receiving the lower member of the firearm magazine, comprising:

providing the rotating support of the one hand firearm magazine loader at an angled position relative to the substantially vertical position;

inserting a bottom of the firearm magazine into the magazine receiving member;

rotating the rotating support, magazine receiving member and firearm magazine to the substantially vertical position;

securing the rotating support, magazine receiving member and firearm magazine with the pair of support arms.

13. A method of using the one hand firearm magazine loader of claim 12, further comprising clipping the one hand firearm magazine loader to a support structure with the clip of the one hand firearm magazine loader.

14. A method of using the one hand firearm magazine loader of claim 12, further comprising using one hand, right or left, and placing a barrel of the firearm onto the magazine with the rotating support, magazine receiving member and firearm magazine in the substantially vertical position until a bottom of the barrel is stopped by the pair of support arms.

15. A method of using the one hand firearm magazine loader of claim 14, further comprising using the same hand to rotate the rotating support, magazine receiving member, firearm magazine, and firearm away from the substantially vertical position, and moving the barrel of the firearm onto the firearm magazine so that the firearm magazine is fully inserted into the firearm.

16. A method of using the one hand firearm magazine loader of claim 15, further comprising using the same hand to move the firearm forward, sliding the firearm off the magazine receiving member, locked and loaded ready to fire, all with the same hand.

17. A method of using the one hand firearm magazine loader of claim 15, wherein the magazine receiving member is rotatably mounted to a top of the rotating support for rotation about a second axis, different from the first axis, of the firearm magazine with mounted firearm, and the method further comprising rotating the magazine receiving member about the second axis relative to the rotating support and using the same hand to move the firearm, sliding it off the magazine receiving member, locked and loaded ready to fire, all with the same hand.

18. A method of using a one hand firearm magazine loader for loading a firearm with a firearm magazine including a lower member, the one hand firearm magazine loader comprising a one-piece magazine support housing including a vertical wall that terminates in a lower end in a receiving section; support arms extending laterally from the vertical wall for retaining a firearm magazine in a substantially vertical position, vertical position; a rotating support rotatably received in the receiving section for rotation about a first axis between the substantially vertical position and an angled position; a magazine receiving member carried by the rotating support, the magazine receiving member receiving the lower member of the firearm magazine, comprising:

using one hand, right or left, and placing a barrel of the firearm onto the magazine with the rotating support, magazine receiving member and firearm magazine in the substantially vertical position until a bottom of the barrel is stopped by the pair of support arms;

using the same hand to rotate the rotating support, magazine receiving member, firearm magazine, and firearm away from the substantially vertical position;

moving the barrel of the firearm onto the firearm magazine so that the firearm magazine is fully inserted into the firearm;

using the same hand to move the firearm forward, sliding the firearm off the magazine receiving member, locked and loaded ready to fire, all with the same hand.

19. A method of using the one hand firearm magazine loader of claim 18, wherein the magazine receiving member is rotatably mounted to a top of the rotating support for rotation about a second axis, different from the first axis, of the firearm magazine with mounted firearm, and the method further comprising rotating the magazine receiving member about the second axis relative to the rotating support and using the same hand to move the firearm, sliding it off the magazine receiving member, locked and loaded ready to fire, all with the same hand.

* * * * *